United States Patent [19]

Schick

[11] Patent Number: 4,799,898

[45] Date of Patent: Jan. 24, 1989

[54] FUSED PLUG

[75] Inventor: Henry Schick, Commack, N.Y.

[73] Assignee: Gilbert Manufacturing Co., Long Island City, N.Y.

[21] Appl. No.: 160,660

[22] Filed: Feb. 26, 1988

[51] Int. Cl.[4] ..... H01R 4/24

[52] U.S. Cl. ..... 439/418; 439/621

[58] Field of Search ..... 439/389, 391, 405, 417, 439/418, 425, 426, 577, 621, 622

[56] References Cited

U.S. PATENT DOCUMENTS 4,648,674 3/1987 Sanchez, Jr. ..... 439/622

4,679,877 7/1987 Ahroni ..... 439/622

*Primary Examiner*—Joseph H. McGlynn

*Attorney, Agent, or Firm*—Darby & Darby

[57] ABSTRACT

The present invention relates to a plug with an integral fuse which is to be inserted into a conventional outlet of a power supply, e.g., an A.C. outlet having openings to accept the two plug's two terminals. It has heretofore been known to provide plugs of this type with a fuse connected in series with one of the lead wires and the corresponding plug terminal which is to be inserted into the outlet. Such fused plugs usually comprise a housing with a replaceable cartridge type fuse therein which is held between a generally U-shaped pair of spring contacts. The housing can be opened to replace the fuse if it blows.

9 Claims, 2 Drawing Sheets

FIG. 3
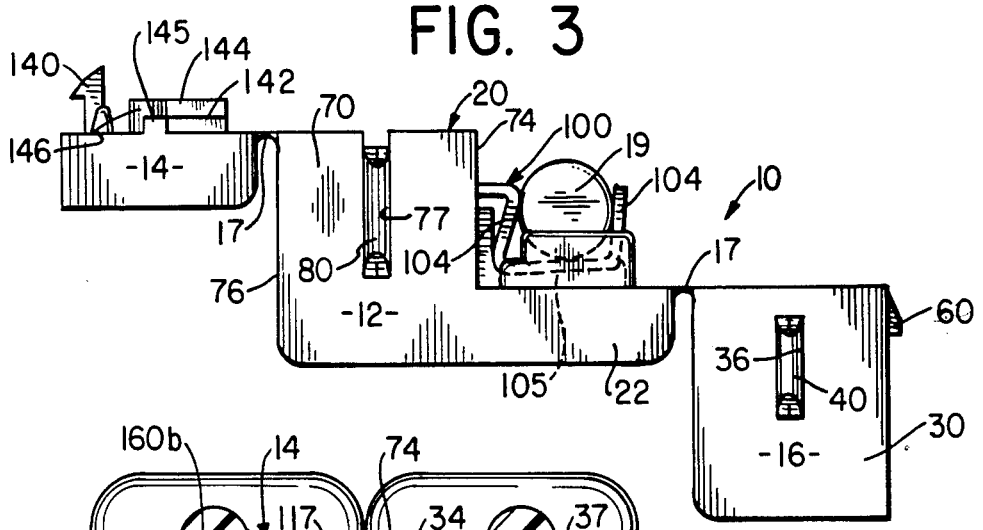
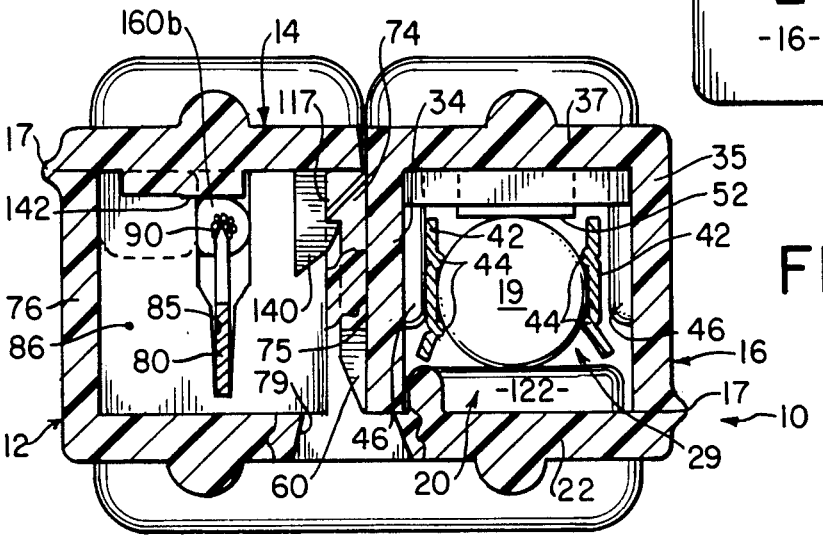
FIG. 4
FIG. 5
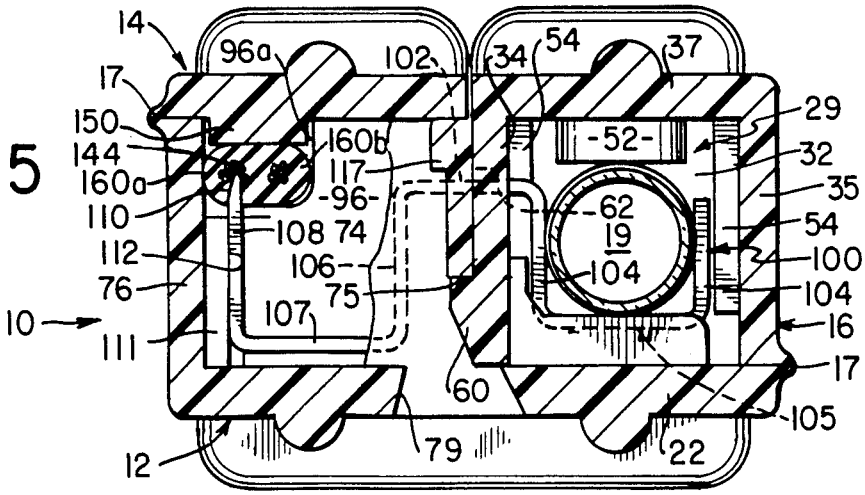

FUSED PLUG

BACKGROUND OF THE INVENTION

The present invention relates to a plug with an integral fuse which is to be inserted into a conventional outlet of a power supply, e.g., an A.C. outlet having openings to accept the two plug's two terminals. It has heretofore been known to provide plugs of this type with a fuse connected in series with one of the lead wires and the corresponding plug terminal which is to be inserted into the outlet. Such fused plugs usually comprise a housing with a replaceable cartridge type fuse therein which is held between a generally U-shaped pair of spring contacts. The housing can be opened to replace the fuse if it blows.

Normally, electrical connection is made between the lead wires and the plug terminals and/or fuse holder of the fused plug by soldering. Since most homeowners do not have ready access to soldering irons or would not know how to properly use them, it becomes difficult, if not impossible to change from a standard plug to a fused plug or to use a fused plug. Fused plugs are often used, for example, on the ends of Christmas trees light strings, or other similar items, so they therefore have decided safety advantage and their use is to be encouraged.

BRIEF DESCRIPTION OF PRESENT INVENTION

The present invention relates to a fused plug which uses a cartridge type fuse and which can be electrically and mechanically connected to a lead wire without the need of soldering. In accordance with the invention, electrical connection to the lead wires is provided by barbed terminals located within the plug housing which pierce through the insulation of the electrically conductive lead wires.

The fused plug of the invention has a housing with several sections which are hinged and foldable relative to each other. One housing section carries the cartridge fuse in a part of a fuse holder which is electrically connected to one of the barbed terminals used to pierce the insulation of one of the lead wires. This section also has one of the plug terminals with a barbed prong to pierce the other lead wire. A second housing section hinged to the first section has the other plug terminal to which is connected the other part of the fuse holder. A third housing section hinged to the first section is used to press the lead wires into the barbed terminals so that the insulation can be pierced to make the required electrical contact.

To assemble the fused plug, the user merely takes the old plug off of the lead wires, or starts with a brand new lead wire, and places the insulated ends of the wire into the first housing section with one lead overlying a respective barbed terminal. One end of the cartridge fuse is placed in the holder in the first section. The second housing section is closed relative to the first to place the other end of the cartridge fuse into the fuse holder part in the second section and the third section is closed relative to the first to force the lead wires inwardly to cause the barbed prongs to pierce through the insulation of a respective lead.

Also in accordance with the invention, the plug housing is made by molding, such as injection molding, as an integral unit with the several sections being hinged so that the molding for making the plug can be carried out in a single mold injection shot. This makes the fused plug economical to produce.

OBJECTS OF THE INVENTION

It is therefore an object of the present invention to provide a fused plug with barbed prongs each to pierce through the insulation of a current carrying lead wire to make electrical contact with the wire when the housing is assembled.

Another object is to provide a fused plug having a one piece housing with several sections, one of which carries a cartridge type fuse and barbed contacts for piercing through the insulation of the current carrying lead wires.

A further object is to provide a fused plug having a cartridge type fuse in which the plug housing automatically grips one end of the fuse and makes electrical connection with the current carrying lead wires upon closing the various parts of the plug housing.

Another object is to provide a fused plug using a cartridge type fuse which is connected to an electrical current carrying wire without soldering.

BRIEF DESCRIPTION OF THE DRAWINGS

Other objects and advantages of the present invention will become more apparent upon reference to the following specification and annexed drawings in which:

FIG. 1 is a top plan view with the plug housing open;

FIG. 3 is an end view of the housing in the opened condition; and

FIGS. 4 and 5 are cross sections of the plug in assembled condition take along lines 4—4 and 5—5 of FIG. 1.

DETAILED DESCRIPTION OF THE INVENTION

Figure 1:
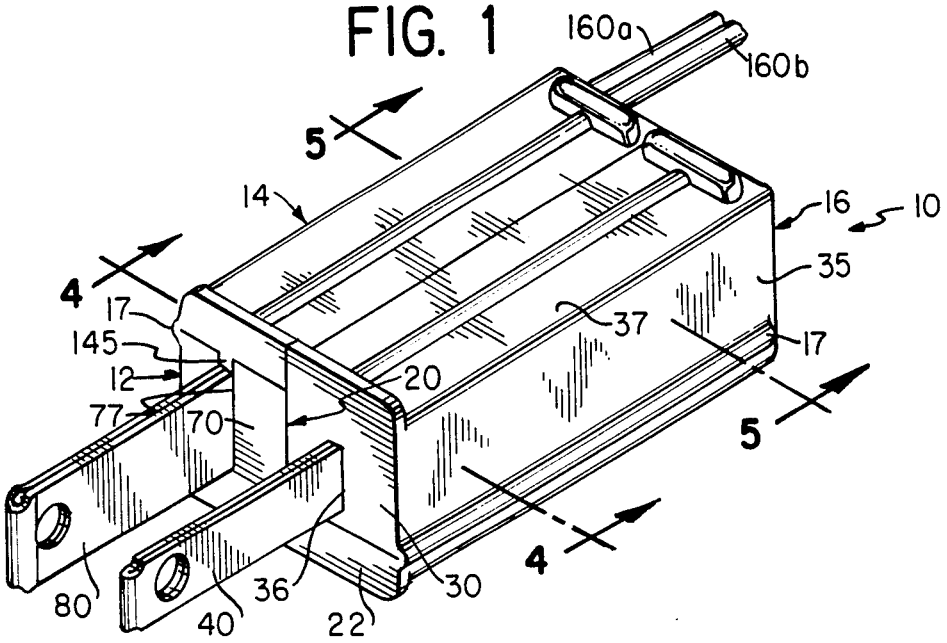
FIG. 1 is a perspective view of the plug in assembled form.

Referring to the drawings, the fused plug 10 is a one piece housing preferably made of suitable plastic material which satisfies the applicable electrical requirements, for example, polypropylene, ABS plastic, etc., in a one step molding operation. It has a central housing section 12 to which are hingedly connected along each edge thereof, left and right housing section 14 and 16 (looking from the front of the housing as shown in FIG. 1). Sections 14 and 16 are connected to the central section 12 by reduced thickness hinges 17 which are formed during the molding portion. These hinges permit section 14, 16 to be folded relative to the central section of 12.

As seen best in FIG. 3, the central section 12 is generally L-shaped and has a major, generally rectangular compartment 20 whose bottom is closed by a base plate 22 with the plate extending outward of the compartment 20. The left housing section 14 is hinged to the top outer edge of compartment 20. The right housing section 16 is hinged to the outer edge of base plate 22. A cartridge fuse 19 of conventional construction with cylindrical, electrically conductive ends, is carried on the base plate 22.

The right section 14 also has a rectangular compartment 29 which when folded covers the base plate 22. The left hand section 16 folds over the compartment 20 of the central section 12. As seen in FIGS. 1, 4 and 5, the combined heights of the central compartment 20 over which the left section 14 has been folded equals that of the base plate 22 over which the right section 16 and its compartment 29 have been folded. Thus, the overall shape of the plug is that of a generally rectangular box.

The rectangular box-like compartment 29 of the right section 16 has end walls 30 and 32 and outer and inner side walls 34, 35. The end wall 30 has an opening 36 through which extends one of the electrically conductive plug terminals 40 which is to be inserted into the outlet. Plug terminal 40 is basically a strip of metal, e.g., brass or other suitable electrically conductive metal, which has been stamped into the desired shape when flat and thereafter folded. The central section of the strip when folded has the desired shape for the extending plug terminal 40. Each of the two ends of the strip is formed with a pair of upwardly extending, resilient opposing arms 42 having a plurality of dimples 44 on the inner face thereof to serve as a part of a fuse holder to accept and hold one end of fuse 19. End side wall 34, 35 of compartment has a vertical boss 46 to confine the outward movement of the fuse holder arms 42.

The bottom wall 37 of the compartment 29 has two raised bosses 52, each positioned to be opposite a conductive end of the fuse 19. The bosses 52 are shown circular in shape but can be of any desired shape. The other end wall 32 of compartment 29 has a vertical rib 54 at each interior corner of its intersection with the side walls 34, 35 to position and restrict endwise movement of the fuse.

Figure 2:
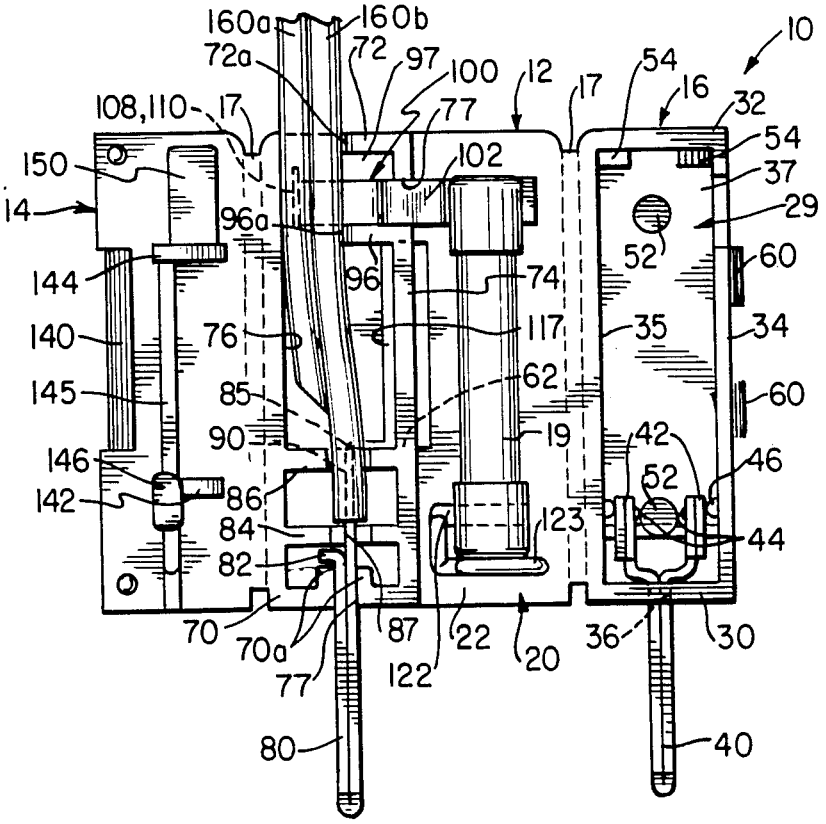

The outer side wall 34 has a pair of locking tabs 60 of generally triangular shape tapering outwardly from the upper edge (as seen in FIG. 2) of the side wall 34. There is also an opening 62 of generally rectangular shape in the side wall 34 near the end wall 32 of compartment 29.

The central section 12 rectangular compartment 20 has end walls 70 and 72 and side walls 74, 76. There is an opening 75 in the side wall 74. The upper edge of opening 75 is at the upper (wider) face of the locking tabs 60 of the right section 16 when the plug is assembled. The bottom wall 22 of the central section 12, which covers the rectangular compartment 20 has an opening 79 to accept a tool, such as a screwdriver, so that the side wall 74 can be moved to disengage the locking tabs 60 of the right section. This permits the housing to be opened if the plug is to be dis-assembled, such as for replacement of the fuse 19.

A pair of ribs 74 are formed on the interior of the end wall 70 on each side of an opening 77 through which the other plug terminal 80 of the plug extends. Plug terminal 80 is also formed from a strip of electrically conductive material which is first stamped and then bent. The strip starts with a stub end 82 which is bent to over lie one of the ribs 74. The strip thereafter projects outwardly and doubles back to form the plug electrical contact portion 80 which is wider than the plug contact 40 as is common for polarized plugs. The other end of the strip passes through two spaced walls 84, 86 which extend across the interior of the compartment 20 between side walls 74, 76. Each of the cross walls 84 and 85 has a respective opening 85, 87 through which the metal strip of plug terminal 80 passes. The two openings 85, 87 are restricted and narrowed at their lower ends to form a fairly tight fit, i.e., a force fit, for the metal strip 80.

The part of the metal strip 80 in the space between the two cross walls 84, 86 is narrower than that of the plug terminal. The end of the strip which rests in the opening 87 of cross wall 86 has a pointed barb, or prong, 90 at its upper end.

Near the other end wall 72 of the center section compartment 20 there is a cross wall 96 defining a subcompartment 97 to accept a terminal 100 (see FIG. 5) which is of two U-shaped parts connected by a center piece 102. One of the U parts is located on the base plate 22 and has a pair of arms 104 connected by a center piece 105 to form the other half of the fuse holder in which the end of the fuse 19 is held. The center piece 102 of the terminal 100 extends through an opening 77 in the side wall 74 of compartment 20 and thereafter bends downwardly at 106. A central piece 107 extends horizontally across the interior of the sub-compartment 97 with terminal 100 terminating in an upwardly extending vertical piece 108 having a barb or prong 11 at its upper end.

There is a vertical boss 111 at the corner of end wall 72 and side wall 76. Boss 111 and the interior of the cross wall 96 each have a slot 112 into which the vertical piece 108 of terminal 100 fits by a force fit.

The third cross wall 96 and the end wall 72 of the center section 12 respective each have openings **96*a* and 72*a* therein which are large enough to accept a lead wire pair 160*a*, 160*b*. The barb 110 extends in the subcompartment 97 in line with the major part of the openings 72*a*, 96*a*. A latching rib 117 (FIG. 2) for the left section 14 is formed on the interior of the side wall 74 in the space between the cross walls 86 and 96**.

The base plate 22 has two cross-rib bosses 122, 123. The metal end of fuse 19 rests on boss 122 of the base plate. The boss 123, which is higher then 122, serves as a stop against lengthwise movement of the fuse.

The housing left section 14 has a vertical, elongated downwardly projecting latch member 140 which is to engage and lock on the latch rib 117 between the two cross walls 86, 96 of the central section.

As seen best in FIG. 2, there is an array of ribs and bosses formed on the inner face of left section 14. Two cross-ribs 142, 144 extend part way across and transverse to the length of the section 14 with the cross-rib 144 projecting down a greater distance than 142. A rib 145 runs along the length of left section 14 from cross-rib 144 to the other end of section 14. An elongated pad 146 is formed adjacent the rib 142 which, when section 14 is folded, fits into the subcompartment between the two cross walls 85, 87 of the central section compartment 20. There is also a generally rectangular pad 150 between cross-rib 14 and close to the end of the section 14.

In using the connector, the user opens up the sections, as shown in FIG. 2. He then takes the lead wire pair **160*a*, 160*b* and cuts 106*a* shorter than 160*b*. The insulated current carrying lead wire pair 160*a*, 160*b* is passed through openings 72*a* and 96*a* and laid within the main internal compartment of the center section 12. The cut lead wire 160*a* is laid over the barb 110 and terminates within the space between the two center compartment cross walls 86, 96. The other insulated lead wire 106*b* is laid into the opening 87 is the cross wall 86 above the barbed terminal 90**.

The user installs one of the metallic ends of the cartridge fuse 19 in the half of the fuse holder formed by the two arms 104 of the connector 100 on the base plate 22.

When the right section 14 is moved to close it (to the left, or counter-clockwise, as shown in FIG. 2), the previously free end of the cartridge fuse 19 is captured between the other half of the fuse holder formed by the two arms 46 of the prong terminal 40. The bosses 52 on the inner surface of the top wall 37 oppose the metal ends of the fuse. The bridging cross piece 102 of the terminal 100 is received in the opening 62 of the side wall 34 of the right section 16 so that section 16 can continue to close relative to the center section. Thereafter, the locking tabs 60 on the outer wall 34 pass into opening 75 on the center section wall 72 and snap over and rest on side wall 74. This completes a firm fastening of the right hand section 16 to the center section 12.

The left section 14 is moved toward the right (or clockwise) as seen in FIG. 2. The boss pad 150 pushes against the lead wire **160*a* to force it against the top of the terminal barb 110 so that the barb 110 pierces through the insulation of lead 160*a* and makes electrical contact with the current carrying lead therein (see FIG. 5). It should be understood that the barb 110** has the proper size to accomplish this.

At the same time, the lengthwise rib 145 which connects the two ribs 142 and 146 on the inner face of section 14 presses against the wire **106*b* to force it against the prong 90 of the terminal 70 to pierce through the insulation and make contact with the electrical wire. The latch rib 140 of 14 snaps under the latch rib 117 in the wall 72. This completes the assembly with the left and right sections 14, 16 firmly fastened to center section 12** by the several snap action locking tabs outlet. If the fuse blows, the user need only open up the right section and replace it. The connection of the lead wires to the barbed terminals is not disturbed. As should be apparent, the fuse plug of the subject invention, is relatively economical to manufacture since it is of one piece construction. In addition, it is easy for even an unskilled user to use an assemble onto the end of a current carrying wire. Thus, the invention makes available a fused plug for applications where an unskilled user might never have used such a device before. This gives rise to the possiblity of making a variety of electrical devices safer to operate.

What is claimed:

1. A fused electrical plug for use with an insulated current carrying lead wire pair for connection to a power source outlet comprising:

a first housing section of electrical insulating material having (a) a first electrical terminal extending therefrom for insertion into said outlet and having a part within said housing section with a first barb thereon for piercing through the insluation of one of said lead wire pair to make electrical connection with the current carrying wire therein, (b) electrically conductive means for contacting one conductive part of an electrical fuse, (c) terminal means electrically connected to said fuse contacting means and having a second barb thereon for piercing through the insulation of the other wire of said lead wire pair to make electrical connection with the current carrying wire therein, a second housing section having:

(a) a second electrical terminal extensing therefrom for insertion into said outlet, (b) electrically conductive means within said second housing section electrically connected to said second electrical terminal for contacting another conductive part of the electrical fuse when the second housing section is assembled to said first housing section.

2. A fused electrical plug as in claim 1 further comprising a third housing section, said third housing section applying pressure to force the wires of the insulated current carrying wire pair against said barbs to piece the insulation of said wires.

3. A fused electrical plug as in claim 2 further comprising hinge means for connecting said second and third housing sections to said first housing section.

4. A fused electrical plug as in claim 2 further comprising respective mating latch means on said first and second and said first and third housing sections to fasten said second and third sections to said first section.

5. A fused electrical plug as in claim 4 further comprising hinge means for connecting said second and third housing sections to said first housing section.

6. A fused electrical plug as in claim 5 wherein said first, second and third housing sections are integral, said second and third sections being connected to said first section by said hing means.

7. A fused electrical plug as in claim 6 wherein said first housing section has a generally rectangular box-like compartment in which said first barb of said first electrical terminal and said second barb as located, said compartment having a base plate with an extension piece which extends outwardly of said compartment, said second housing section being generally rectangular and box-like in shape and hinged to an edge of and fitting over said base plate extension piece, said third housing section hinged to said compartment of said first housing section and fitting thereover.

8. A fused electrical plug as in claim 7 wherein said fuse contacting means of said first housing section is loaded overlying said base plate.

9. A fused electrical plug as in claim 7 wherein said fuse contacting means of said first and second housing sections each comprise a pair of spring arms to hold one end of an elongated cartridge type fuse, said fuse contacting means being at opposite ends of said base plate wherein said housing sections are assembled.

* * * * *